US009706837B2

(12) United States Patent
Kosmach

(10) Patent No.: US 9,706,837 B2
(45) Date of Patent: Jul. 18, 2017

(54) COMPACT FOLDED GARMENT STORAGE DISPLAY AND DISPENSING DEVICE

(71) Applicant: Daniel S. Kosmach, St. Thomas, VI (US)

(72) Inventor: Daniel S. Kosmach, St. Thomas, VI (US)

( * ) Notice: Subject to any disclaimer, the term of this patent is extended or adjusted under 35 U.S.C. 154(b) by 66 days.

(21) Appl. No.: 14/714,324

(22) Filed: May 17, 2015

(65) Prior Publication Data

US 2015/0329276 A1 Nov. 19, 2015

Related U.S. Application Data

(60) Provisional application No. 61/994,958, filed on May 18, 2014.

(51) Int. Cl.

| | |
|---|---|
| ***B65D 71/70*** | (2006.01) |
| ***A47B 61/00*** | (2006.01) |
| ***B65D 85/18*** | (2006.01) |
| ***B65D 21/02*** | (2006.01) |
| ***A47B 87/02*** | (2006.01) |
| ***A47B 97/00*** | (2006.01) |

(52) U.S. Cl.

CPC ..... *A47B 61/003* (2013.01); *A47B 87/0269* (2013.01); *A47B 97/00* (2013.01); *B65D 21/0209* (2013.01); *B65D 85/18* (2013.01); *A47B 87/0207* (2013.01)

(58) Field of Classification Search

CPC ..... A45C 2013/026; A45C 13/1969; A45C 13/1069; B65D 21/0209; B65D 71/70; B65D 85/18

USPC ..... 206/292, 558.818; 211/85.3, 126.5; 312/126

See application file for complete search history.

(56) References Cited

U.S. PATENT DOCUMENTS

| | | | | |
|---|---|---|---|---|
| 2,710,082 A * | 6/1955 | Ruge | A45C 5/00 206/289 |
| 2,873,830 A * | 2/1959 | Wilt | A45C 13/03 190/109 |
| 3,734,249 A * | 5/1973 | Wilt | A45C 13/03 190/109 |
| 5,150,776 A * | 9/1992 | Rebenack | A45C 13/02 190/110 |

(Continued)

FOREIGN PATENT DOCUMENTS

SU 988670 A * 1/1983

*Primary Examiner* — Sue A Weaver
(74) *Attorney, Agent, or Firm* — Peter James Lynch

(57) ABSTRACT

This compact storage, display, and dispensing system for folded garments comprises a plurality of stackable, flexible trays, each of which may hold a uniformly-folded garment, and vertical rails to which each tray may attach individually by magnets in single reinforced tray edges. Trays have nonslip upper surfaces so the garments do not slide off. Users view and select a desired garment, then remove the appropriate tray without disturbing adjacent garments or trays by simply pulling to overcome the magnetic force holding that tray attached. The remaining trays remain attached, and the force of gravity causes them to slide down the rails to occupy the space previously occupied by the now removed tray. Empty trays can either be added to the top of the stack, or removed for refilling. Due to the force of the magnets, removed trays remain in neat vertical stacks, either when empty or refilled.

2 Claims, 7 Drawing Sheets

(56) References Cited

U.S. PATENT DOCUMENTS

| | | | | |
|---|---|---|---|---|
| 5,195,620 | A * | 3/1993 | Tate | A45C 13/03 190/110 |
| 6,520,514 | B2 * | 2/2003 | Clegg | A45C 5/14 280/47.26 |
| 6,595,604 | B1 * | 7/2003 | Peterson | A01K 97/06 190/110 |
| 6,749,273 | B1 * | 6/2004 | Peterson | A01K 97/06 190/110 |
| 2005/0121275 | A1 * | 6/2005 | Platte, III | A45C 5/14 190/103 |
| 2005/0126872 | A1 * | 6/2005 | Dror | A45C 9/00 190/107 |
| 2008/0056810 | A1 * | 3/2008 | Granata | B60R 13/0206 403/121 |
| 2011/0108550 | A1 * | 5/2011 | Vines | A45C 13/02 220/23.86 |
| 2014/0138378 | A1 * | 5/2014 | Lequeux | A45C 13/1069 220/23.83 |

* cited by examiner

COMPACT FOLDED GARMENT STORAGE DISPLAY AND DISPENSING DEVICE

CROSS REFERENCE TO RELATED APPLICATION

This application claims priority to and the benefit of U.S. Provisional Patent Application 61/994,958 filed May 18, 2014, titled "Compact Folded Garment Storage Display and Dispensing Device" which is incorporated herein by reference in its entirety.

FIELD OF THE INVENTION

The field of the invention relates to space saving devices for storage, display, and dispensing of articles of clothing.

BACKGROUND OF THE INVENTION

This invention is a device which saves space and manpower, improves efficiency and preserves tidiness in the compact storage, display, selection, and dispensing of uniformly sized folded garments in either a residential or a retail environment.

Modern residential dwelling units frequently have limited closet space. With limited hanging space, not all clothes can be stored on hangers. What's more, hanger usage can stretch or damage shirt necks, or leave telltale epaulette-like indents on shirts. Some garments are better stored folded.

Current options for storage of folded garments, which include drawers, cabinets, cubbies, storage tubs, or simply stacking the folded garments one on top of the other on a shelf, each have drawbacks. All of the current options waste space by not being able to stack vertically without encountering these drawbacks.

For example, when searching for a particular garment in a drawer, if that garment is not visible, the user must physically remove the top garments in order to find what lies beneath, or rummage through the drawer contents, wasting time and often leaving the unselected folded garments rumpled and messy. Pulling out one folded garment from the middle of a stack on a closet shelf can likewise disturb adjacent folded garments, or, worse still, initiate the dreaded closet avalanche.

Similar issues exist in a retail setting. Clothing retailers generally strive to display their wares of slacks or shirts neatly folded and stacked on shelves, for an attractive presentation. Customers looking for a garment of a particular size or color sift through the pile, leaving the display unsightly and disorganized, and forcing the clothing retailer to expend untold man-hours tidying up after customers.

The device claimed was created to solve these folded garment storage, selection, and dispensing problems in a unique way. It saves space and time, providing a neat, compact storage, organization, display, selection, and dispensing solution for a wide variety of relatively uniformly sized, folded garments.

SUMMARY OF THE INVENTION

The invention comprises a stack of a plurality of trays with a nonslip surface applied to or made part of a portion of their upper surfaces, which may hold uniformly folded garments, and a plurality of vertical rails to which said trays may be attached. In normal usage, said trays are stacked one atop the other, while individual trays are temporarily attached by a plurality of magnets in one edge to an equal plurality of paralle, substantially vertical rails. The device is intended to rest upon a horizontal, planar surface such as a shelf, dresser, or the bottom of a drawer, cabinet, or retail store display cubby. A user, whether residential or retail, can easily view all stored garments in the stack simply by lifting and fanning through the fronts of the flexible trays, much as one would thumb through the pages of a book or a stack of index cards, or, if space allows, by viewing the stack from the side. When the desired article of clothing is found, the user then removes the selected garment-holding tray by merely pulling it with a nominal force sufficient to overcome the magnetic force which holds the rear edge of the tray attached to the parallel rails. Throughout this procedure, the remaining trays remain in position, magnetically attached to the parallel rails. This process does not disturb the trays above or below, so a neat, compact storage and display system is maintained. Gravity causes the stack to settle and fill the gaps left by previously removed trays. As the user dispenses garments in this manner, newly emptied trays can be added to the top of the stack and reattached to the support rails, awaiting refill. When ready to refill the trays, the user removes empty trays either singly or as part of a stack by means of the process described above, in preparation for refilling the trays with newly folded garments. Due to the force of the magnets, when placed on a flat, horizontal surface such as a garment folding station, these removed trays tend to remain aligned in neat vertical stacks until forcibly pulled apart, whether empty or already refilled with folded garments.

Advanced features may be incorporated, such as tray tab protrusions to facilitate pulling a tray or viewing the selection of garments held by a stack of trays, tray ventilation holes to allow air circulation, prevent suction between trays as they are manipulated, and save material, a vertical spacer on the tray edge opposite the reinforced tray edge to facilitate keeping trays in an approximately horizontal orientation when stacked, an alignment cutout from the top of the reinforced tray edge to make lateral alignment easier when adding a tray to the stack, a concave shape to the tray upper surface to improve its characteristic to hold a folded garment, a nonslip surface on a portion of each tray's upper surface to prevent folded garments from sliding off, longitudinal splines on the bottom of each tray's reinforced edge to reduce friction with articles below it, and removal of the lower portion of the lateral vertical outer face of each tray's reinforced edge so as to eliminate any hazard of catching on folded garments, buttons, or trays below it. All of the above advanced features are incorporated into the preferred embodiment.

Alternative embodiments include trays which are concave in their cross section, which may nest between the adjacent trays above and below them in a stack.

Still other embodiments include every permutation of the advanced features described above.

BRIEF DESCRIPTION OF THE DRAWINGS

The features of the invention believed to be novel and the elements characteristic of the invention are set forth with particularity in the claims. The figures are for illustration purposes only. The invention itself, however, both as to organization and method of operation, may be understood by reference to the detailed description which follows taken in conjunction with the accompanying drawings in which the drawings show typical embodiments of the invention and are not intended to be limiting of its scope.

DRAWINGS REFERENCE NUMERALS

1—a tray, or the upper surface of a tray.
2—reinforced tray edge
3—permanent magnets
4—tab protrusion
5—ventilation holes
6—vertical spacer
7—alignment cutout
8—tray upper surface bend axis
9—nonslip surface
10—longitudinally oriented splines
11—removed portion of outer transverse vertical side of reinforced tray edge
12—parallel, substantially vertical rails
13—stack of trays

DETAILED DESCRIPTION OF THE INVENTION

Figure 1:
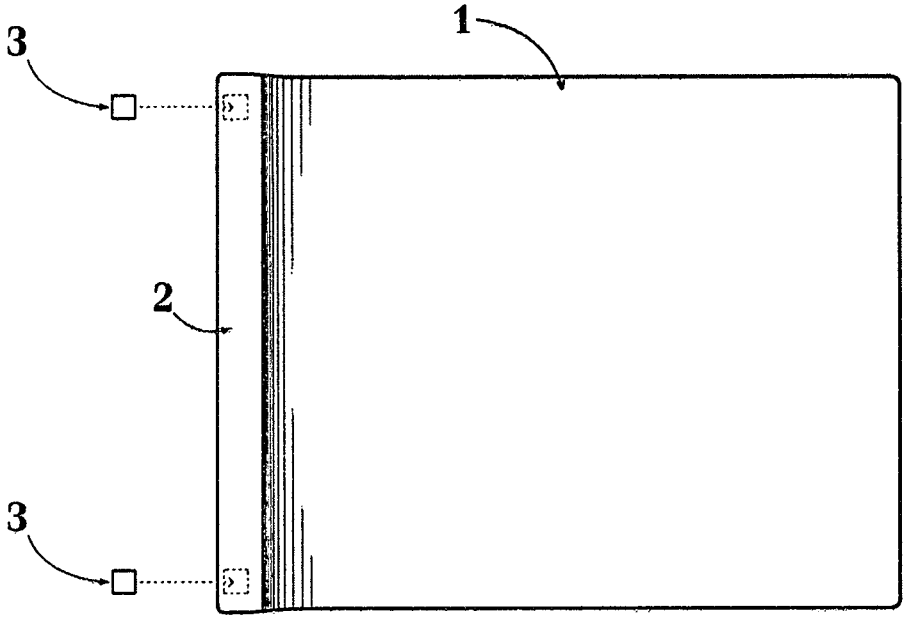
FIG. 1 depicts a plan view of a single tray in one embodiment of the invention.
Figure 2:
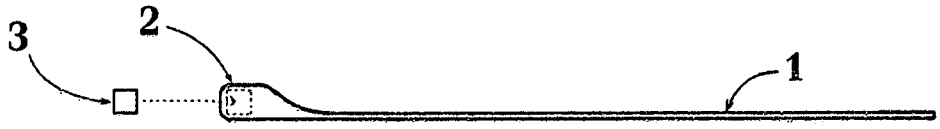
FIG. 2 shows a profile view of a single tray in one embodiment of the invention.
Figure 3:
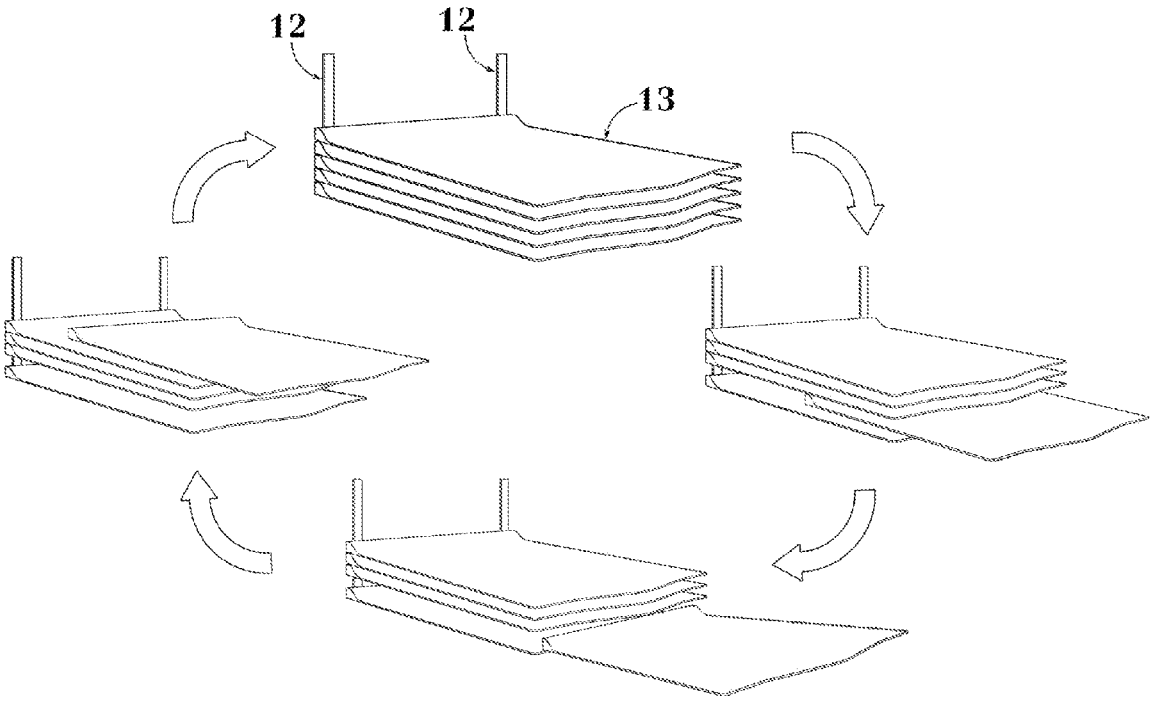
FIG. 3 at top shows a perspective view of the rails and a stack of trays in the stowed configuration, then proceeding clockwise shows the sequence of events as a tray is removed from the stack and replaced at the top of the stack, at which point the trays slide down the rails and return to the stowed configuration.

The invention in its most basic form comprises a plurality of trays 1, as shown in FIGS. 1 and 2, each of which trays may hold a uniformly folded garment, which trays may be placed one atop the other to form a stack 13, and which trays are individually attached to a plurality of parallel, substantially vertical rails 12, as shown in FIG. 3, for a compact storage solution that takes advantage of previously wasted vertical space.

Each of said trays 1 is flexible, for easy bending, and is substantially planar in some embodiments, as shown in FIGS. 1 and 2, has a concave upper surface 1 in other embodiments, as shown in FIGS. 9-12, and is of concave cross section in yet other embodiments.

FIGS. 1 and 2 show a single tray 1 of approximately rectangular shape in the plan view and profile view, respectively, with one reinforced tray edge 2 containing a plurality of permanent magnets 3.

A plurality of trays placed on top of one another forms a stack 13 as shown in FIG. 3. Each tray individually attaches by magnetic force to a plurality of parallel substantially vertical rails 12 secured to the environs, which rails 12 are composed of a material to which magnets attract.

The bottom tray rests upon a flat horizontal surface, which surface is normally a shelf or a floor of the environs.

By flipping through the stack 13 of trays, a user can view the selection of garments. Once a garment is selected, the user may remove the tray containing that garment from the stack by pulling to overcoming the magnetic force that holds said tray 1 attached to said rails 12.

FIG. 3 at top shows a perspective view of an initial condition of the rails 12 and a stack of trays 13 attached in the stowed configuration; proceeding clockwise in FIG. 3, the sequence of events in a cycle of operation is demonstrated in chronological order, as a tray is first removed from the stack and finally replaced at the top of the stack. The device takes advantage of the force of gravity, which causes the remaining trays to slide down the rails 12 to the space formerly occupied by the now-removed tray, and maintain a neat stack 13. Empty trays, or trays holding newly folded garments are simply added onto the top of the stack.

Figure 10:
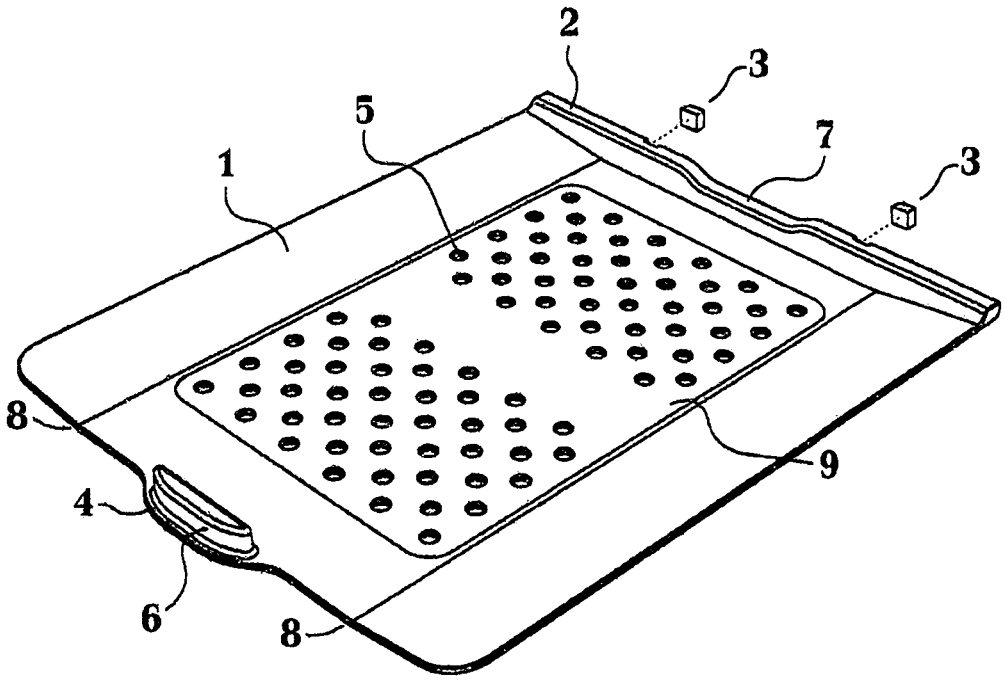
FIG. 10 shows a perspective view of a tray of the preferred embodiment, with a concave upper surface created by two bends in the tray surface, also incorporating the features of a tab protrusion, a plurality of ventilation holes, a vertical spacer, an alignment cutout, and a nonslip surface.
Figure 11:
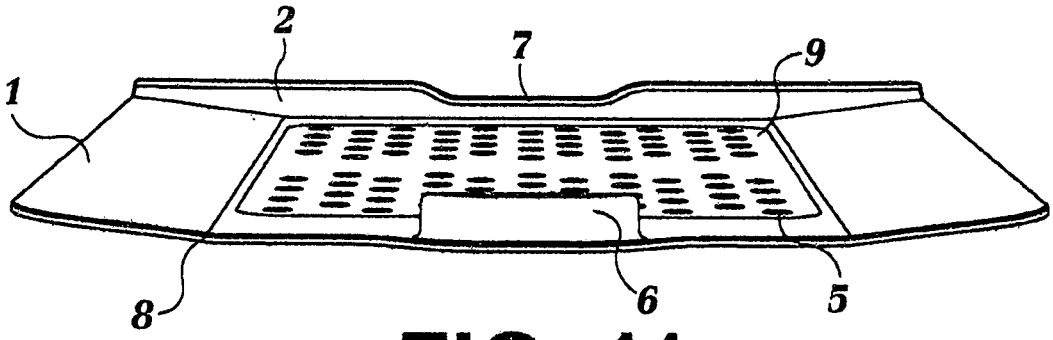
FIG. 11 shows a different perspective view of the tray of the preferred embodiment of FIG. 10, looking across the vertical spacer longitudinally from a point slightly above the tray surface.

A portion of the upper surface 1 of each tray has a nonslip surface 9 as shown in FIGS. 10 and 11, to increase friction and facilitate holding a folded garment in place.

Figure 4:
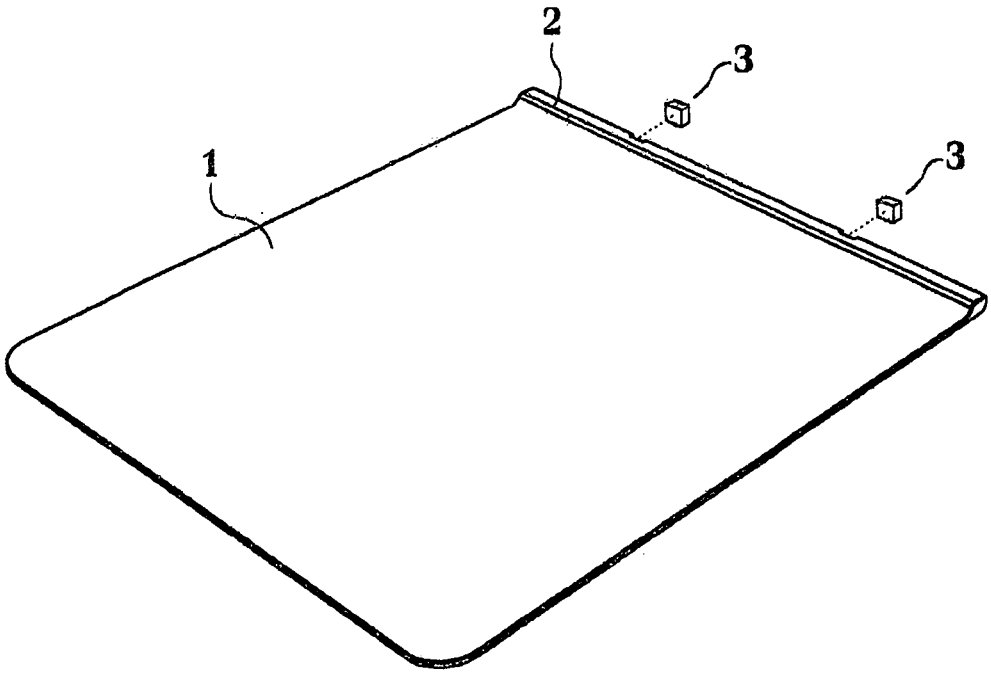
FIG. 4 shows a perspective view of an approximately planar, approximately rectangular tray.

In some embodiments, each tray's upper surface 1 is approximately planar, and approximately rectangular, with generally straight edges, as shown in FIG. 4. FIG. 4 shows the reinforced tray edge 2, and indicates the position of the plurality of permanent magnets 3.

In some embodiments, the permanent magnets are neodymium magnets, in order to provide a stronger magnetic field and better holding power.

Figure 5:
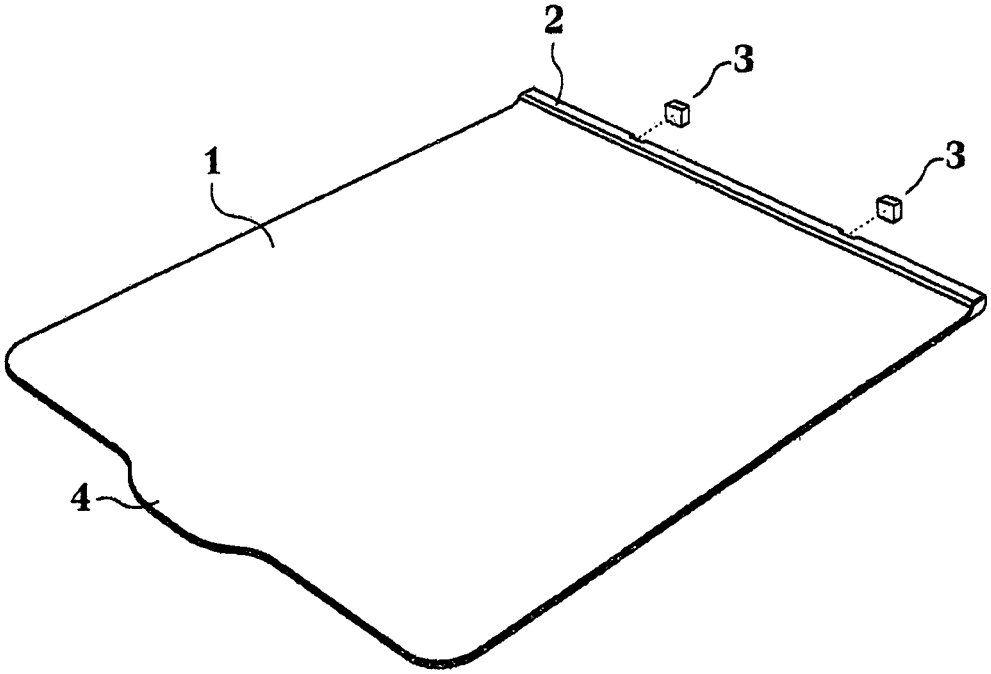
FIG. 5 shows a perspective view of an approximately planar, approximately rectangular tray with the additional feature of a tab protrusion on the edge of the tray opposite the reinforced tray edge.
Figure 6:
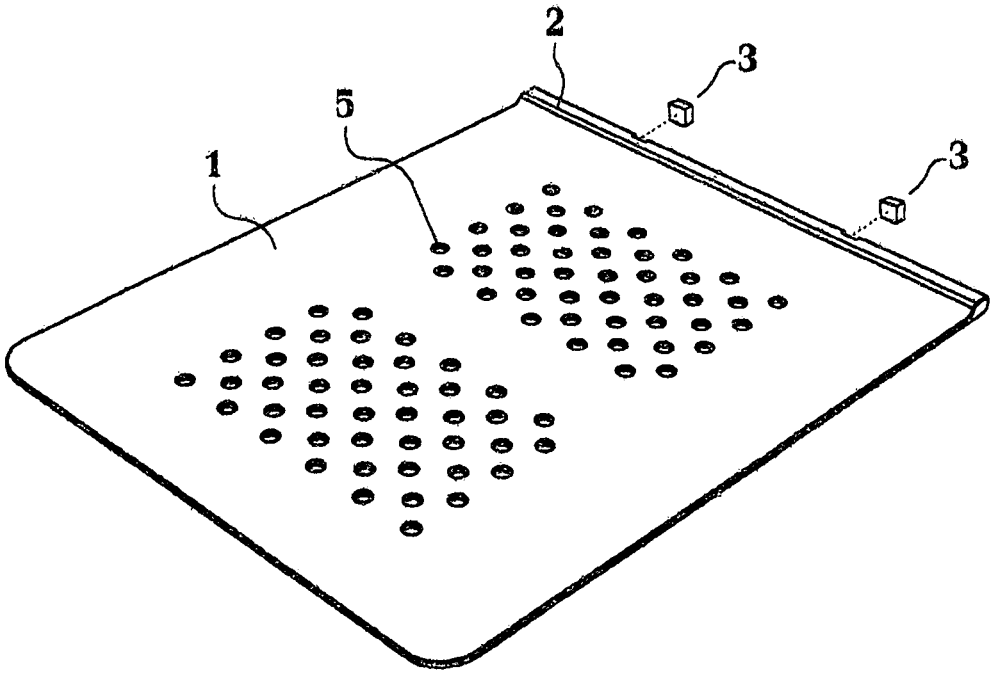
FIG. 6 shows a perspective view of an approximately planar, approximately rectangular tray with the additional feature of a plurality of ventilation holes through it.

In some embodiments, as shown in FIG. 5, each tray has a tab protrusion 4 which protrudes from the edge of the tray opposite the reinforced tray edge 2, to facilitate pulling a tray to remove it or facilitate flipping through trays to view their contents much as one thumbs through the pages of a book.

In some embodiments, as illustrated in FIG. 6 and FIGS. 10-12, each tray has a plurality of ventilation holes 5 to maximize fresh air circulation and prevent suction as trays are moved and separated, and also to reduce material needed for manufacture.

Figure 7:
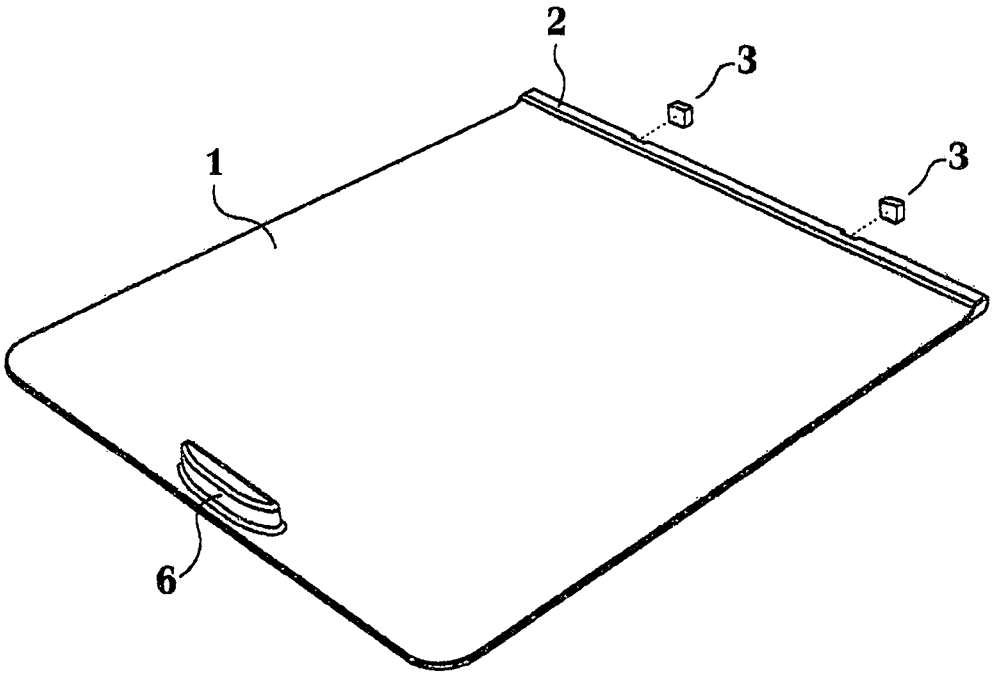
FIG. 7 shows a perspective view of an approximately planar, approximately rectangular tray with the additional feature of a vertical spacer on the edge of the tray opposite the reinforced tray edge.
Figure 13:
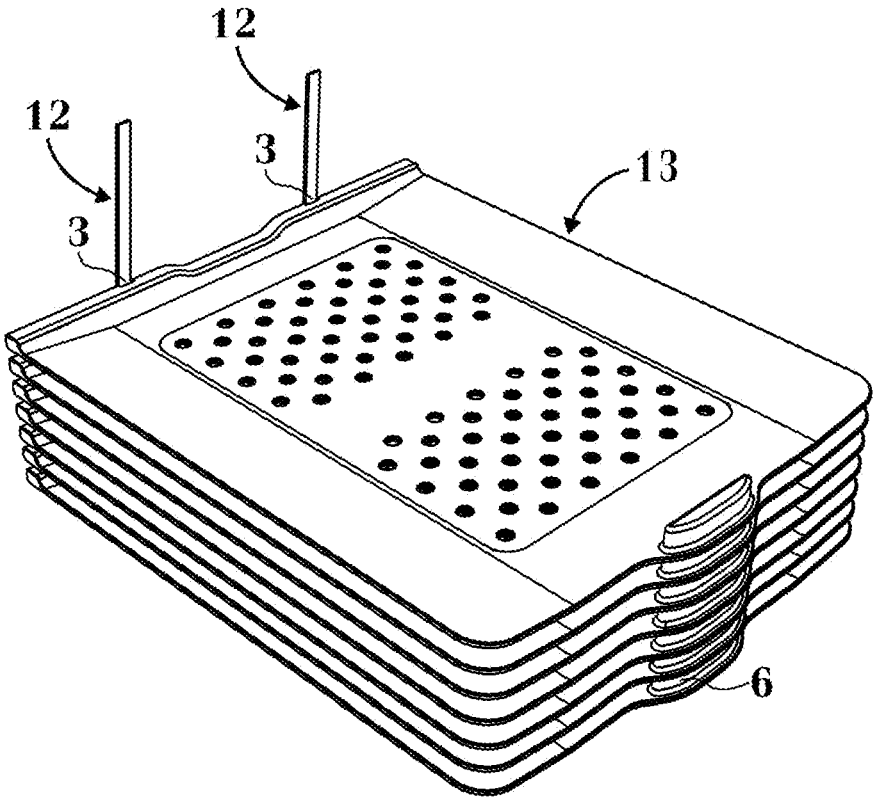
FIG. 13 shows the preferred embodiment, with a stack of trays held to two vertical rails by two magnets, and maintained in a substantially horizontal position by the vertical spacers.

In some embodiments, as depicted in FIG. 7, a vertical spacer 6 is attached to the upper surface 1 of each tray along the tray edge opposite the reinforced tray edge 2. Said vertical spacers 6 help to maintain each tray in an approximately horizontal orientation when stacked 13 with other trays, and also bear some of the weight of trays above, thereby reducing wrinkles in the folded garments. FIG. 13 shows a stack 13 of trays employing the spacer feature to keep their approximate horizontal alignment.

Figure 8:
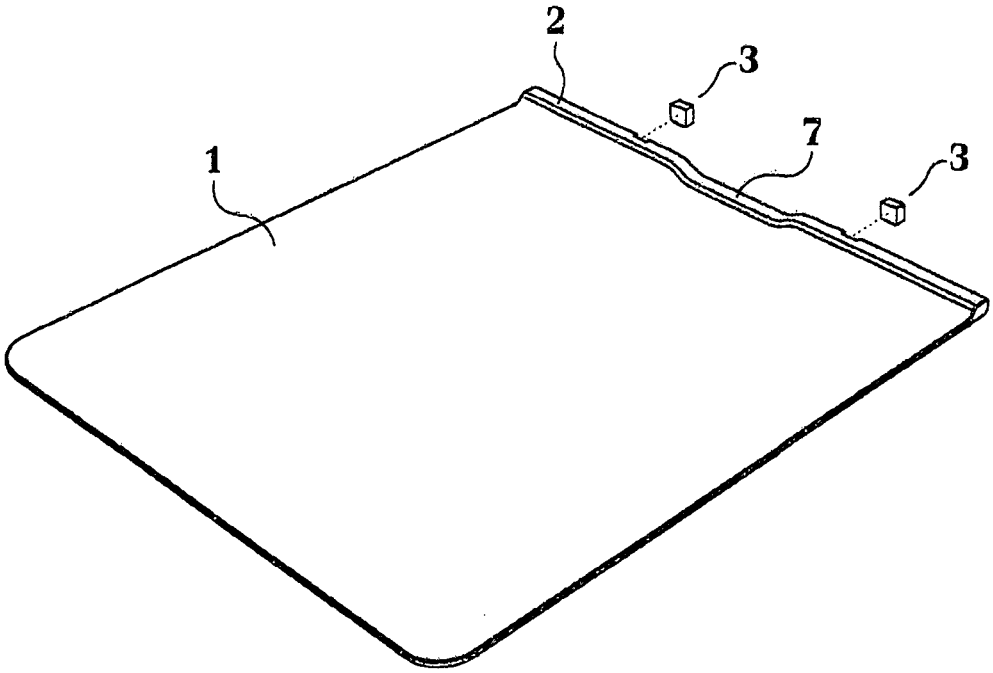
FIG. 8 shows a perspective view of an approximately planar, approximately rectangular tray with the additional feature of an alignment cutout from the top center of the reinforced tray edge.

In some embodiments, each tray has a cutout 7 of material removed from the upper surface of each tray's reinforced edge 2, as shown in FIG. 8, which facilitates lateral alignment of the tray as said tray is initially slid into position and attached to the vertical rails 12 or added to the stack 13 by the process described of FIG. 3 described above, of which the final configuration is as shown in FIG. 13. Cutout 7 also serves to save material in manufacturing, and to reduce friction.

Some embodiments employ a concave upper surface 1 on each tray, to take advantage of the force of gravity to facilitate said tray's ability to hold and to keep a folded garment centered upon its upper surface 1, to control the flexibility of the tray, and to facilitate the manufacturing process.

Figure 9:
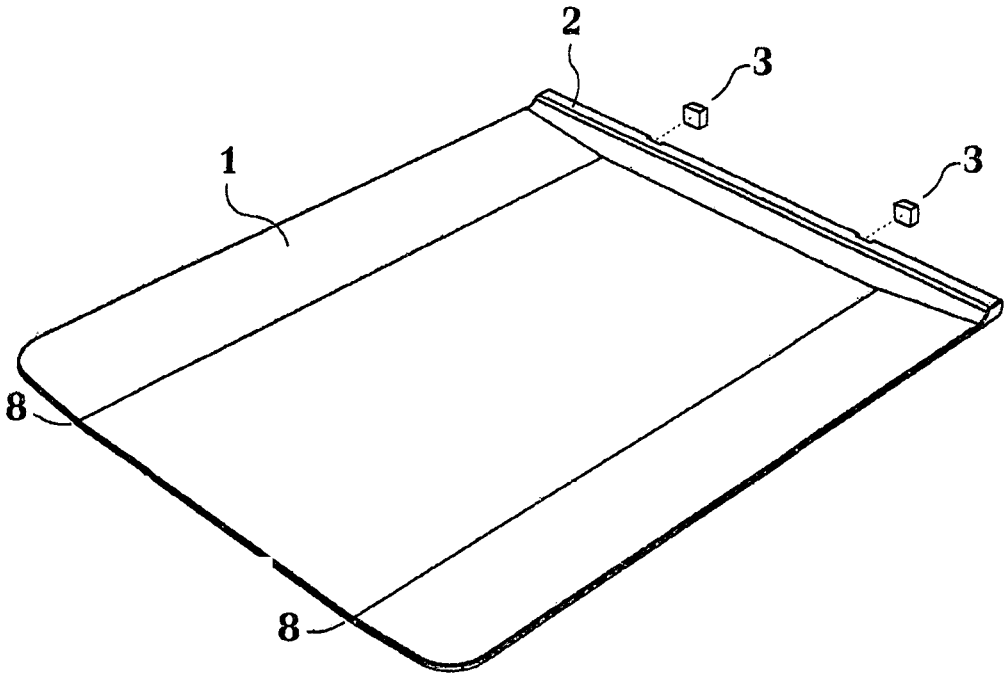
FIG. 9 shows a perspective view of a tray with a concave upper surface created by bends in the tray surface along a plurality of longitudinal axes.

In some embodiments said concave upper surface is achieved as depicted in FIG. 9, in which said tray upper surface 1 is bent along a plurality of longitudinal bend lines 8.

In some embodiments a portion of each tray's upper surface 1 is composed of a nonslip surface 9, as shown in FIGS. 10 and 11, to increase friction and facilitate said tray's ability to hold a folded garment securely.

Figure 12:
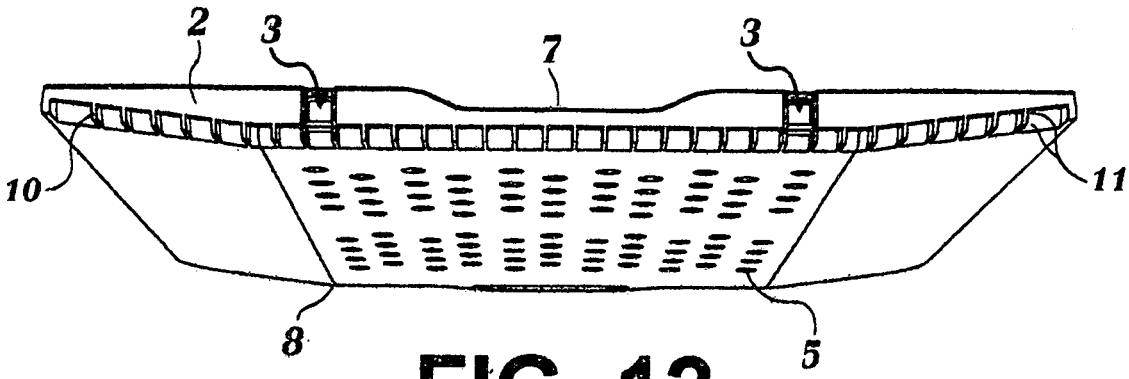
FIG. 12 shows yet another perspective view of the tray of the preferred embodiment of FIG. 10, looking underneath the reinforced tray edge longitudinally from a point slightly below the tray, and showing two additional features of the preferred embodiment; longitudinal splines on the bottom edge of the reinforced tray edge, and a cutaway of the lower portion of the outer transverse vertical face of the reinforced tray edge.

Certain embodiments have longitudinal splines 10 along the bottom edge of each tray's reinforced edge 2, as depicted in FIG. 12, to reduce removal friction with the item below upon which the tray rests, and to facilitate manufacturing.

As is also shown in FIG. 12, certain embodiments have removed the lower portion 11 of the outer transverse vertical reinforced tray edge 2 surface to prevent the tray edge from catching on clothing or buttons as it is removed from the stack 13.

The preferred embodiment of claim 10 is depicted in FIGS. 10-13; it employs two vertical rails 12 and a plurality of trays in a stack 13 as shown in FIG. 13; each individual tray employs two permanent magnets 3, as shown in FIGS. 10 and 12, which magnets 3 are neodymium magnets, a tray pull tab 4, as shown in FIG. 10, a plurality of ventilation holes 5, as shown in FIGS. 10-12, a vertical spacer 6, as shown in FIGS. 10, 11, and 13, a "U"-shaped alignment cutout 7 of said reinforced tray edge 2, as shown in FIGS. 10-12, two longitudinal bend lines 8 to achieve a concave upper tray surface 1, as shown in FIGS. 10-12, a portion 9 of nonslip surface on said tray's upper surface 1, as shown in FIGS. 10 and 11, longitudinal splines 10 on the bottom of said reinforced tray edge 2, as shown in FIG. 12, and a cutout 11 of the lower portion of the outer transverse vertical reinforced tray edge 2 surface, as shown in FIG. 12. FIG. 13 shows the preferred embodiment entire invention, comprising a stack 13 of trays each of which trays' upper surfaces 1 are partly nonslip 9, each tray having a protruding tab 4, a plurality of ventilation holes 5, a vertical spacer 6, a concave upper surface formed by bend axes 8, an alignment cutout 7 of the upper reinforced tray edge, longitudinal splines 10 on the reinforced tray edge bottom surface, and the removed lower portion 11 of the outer vertical reinforced tray edge 2.

Some embodiments include only the most basic features of the device, namely a plurality of flat, substantially planar stackable trays 1 as depicted in FIGS. 1-3, with reinforced tray edges 2 and a portion of their surface 1 made nonslip 9, a plurality of permanent magnets 3, and a plurality of parallel substantially vertical elongated rails 12 to which said trays may attach.

Other embodiments employ every permutation from the group of improvement features of permanent magnets 3 that are neodymium magnets to increase magnetic force and holding power, larger sized permanent magnets 3 to increase magnetic force and holding power, tray tab protrusions 4 to facilitate pulling, searching, and manipulating, a plurality of tray ventilation holes 5 to eliminate suction as trays are moved and to reduce material costs, a vertical spacer 6 on the upper tray edge opposite the reinforced tray edge 2 to facilitate keeping trays 1 and the stack 13 approximately horizontal, and to bear a portion of the weight of trays above, minimizing wrinkles in the folded garment held, a slightly concave upper tray surface with longitudinal bend axes 8 to better hold a folded garment, a concave tray cross section to enable adjacent trays to nest together, variations in the nonslip surface 9 material, texture, and geometry of the portion of each tray upper surface 1 to which it is applied, to improve the tray's ability to hold a folded garment, an alignment cutout 7 from the upper portion of each reinforced tray edge 2, to facilitate lining up a tray's magnets with the rails as a tray is slid into position, a plurality of longitudinally oriented splines 10 on the bottom side of each reinforced tray edge 2 to reduce friction with the tray and the garment directly below, and a removed lower portion 11 of the outer transverse vertical side of each reinforced tray edge 2 in order to avoid the tray edge from catching on a garment or button below it when removed.

Some embodiments employ the feature a plurality of thin, flexible, substantially horizontal, nesting, stackable trays 1 of concave cross-section, to facilitate the quality of providing a stable, compact stack 13 of trays that, by virtue of their curved cross-section, nest in between the trays directly above and below them.

Some embodiments employ the feature a plurality of thin, flexible, substantially horizontal, nesting, stackable trays 1 of concave cross-section, to facilitate the quality of providing a stable, compact stack 13 of trays that, by virtue of their curved cross-section, nest in between the trays directly above and below them, and further employ a means providing nonslip qualities to a portion of the upper side of each of said trays, chosen from the group of a textured finish, a material having the property of high friction with garments it contacts, and a combination of the two first members of the group.

Other embodiments begin with the embodiments, and then employ every permutation from the group of improvement features: of permanent magnets 3 that are neodymium magnets to increase magnetic force and holding power; larger sized permanent magnets to increase magnetic force and holding power; tray tab protrusions 4 to facilitate pulling, searching, and manipulating; a plurality of tray ventilation holes 5 to eliminate suction as trays are moved and to reduce material costs; a vertical spacer 6 on the upper tray edge opposite the reinforced tray edge 2 to facilitate keeping trays 1 and the stack 13 approximately horizontal, and to bear a portion of the weight of trays above, minimizing wrinkles in the folded garment held; a slightly concave upper tray surface with bend axes 8 to better hold a folded garment; a concave tray cross section to enable adjacent trays to nest together; nonslip surface 9 material, texture, and geometry of the portion of each tray upper surface 1 to which it is applied, to improve the tray's ability to hold a folded garment; an alignment cutout 7 from the upper portion of each reinforced tray edge 2, to facilitate lining up a tray's magnets with the rails as a tray is slid into position; a plurality of longitudinally oriented splines 10 on the bottom side of each reinforced tray edge 2 to reduce friction with the tray and the garment directly below; and a removed lower portion 11 of the outer transverse vertical side of each reinforced tray edge 2 in order to avoid the tray edge from catching on a folded garment, button or tray below it when removed.

In some embodiments, the positioning of the permanent magnets 3 is such that a stack 13 of trays will self-align in position directly over one another, whether or not attached to the parallel vertical rails 12.

Some embodiments of the invention are suitable for the compact storage of a variety of items other than folded garments, including books, compact discs, and articles of jewelry.

What is claimed:

1. A device for compactly and neatly storing, displaying, and dispensing uniformly sized folded garments, comprising: a plurality of stackable trays with tray edges, a plurality of parallel, substantially vertical, elongated rails, composed of a material to which a magnet attracts; a plurality of permanent magnets made a part of one tray edge as a means for temporarily attaching each said tray edge to said elongated rails, and for allowing trays to be individually removed from any position in the stack, and to slide down the rails to automatically fill gaps created by removal of trays.

2. The device of claim 1 wherein the number of said permanent magnets is two, and the number of said elongated rails is two.

* * * * *